US005220273A

United States Patent [19]

Mao

[11] Patent Number: 5,220,273

[45] Date of Patent: Jun. 15, 1993

[54] REFERENCE VOLTAGE CIRCUIT WITH POSITIVE TEMPERATURE COMPENSATION

[75] Inventor: Robert S. Mao, Hsinchu, Taiwan

[73] Assignee: Etron Technology, Inc., Hsinchu, Taiwan

[21] Appl. No.: 815,521

[22] Filed: Jan. 2, 1992

[51] Int. Cl.[5] ..... G05F 3/16

[52] U.S. Cl. ..... 323/313; 323/907; 323/901; 323/316

[58] Field of Search ..... 323/313, 907, 901, 314, 323/315, 316; 307/296.6, 296.8

[56] References Cited

U.S. PATENT DOCUMENTS

| | | | |
|---|---|---|---|
| 3,421,375 | 1/1969 | Dimon | 323/907 |
| 3,648,153 | 3/1972 | Graf | 323/1 |
| 3,648,154 | 3/1972 | Frederiksen et al. | 323/314 |
| 4,088,941 | 5/1978 | Wheatley, Jr. | 323/8 |
| 4,774,452 | 9/1988 | Ahmed | 323/314 |
| 4,857,823 | 8/1989 | Bitting | 323/314 |
| 5,061,862 | 10/1991 | Tamagaw | 307/296.1 |

*Primary Examiner*—Steven L. Stephan
*Assistant Examiner*—Ben M. Davidson
*Attorney, Agent, or Firm*—George O. Saile

[57] ABSTRACT

A circuit for producing a reference voltage, particularly for a voltage regulator, has a current source that produces the desired reference voltage across a string of components. The current source is controlled by a differential amplifier that receives inputs that vary with chip temperature. The differential amplifier increases the reference voltage when the chip temperature increases. When the voltage regulator is used with an FET memory, the increase in the regulator voltage with temperature helps to compensate for an increase in the rate that FET storage cells lose the charge that represents data.

5 Claims, 1 Drawing Sheet

REFERENCE VOLTAGE CIRCUIT WITH POSITIVE TEMPERATURE COMPENSATION

FIELD OF THE INVENTION

Figure 1:
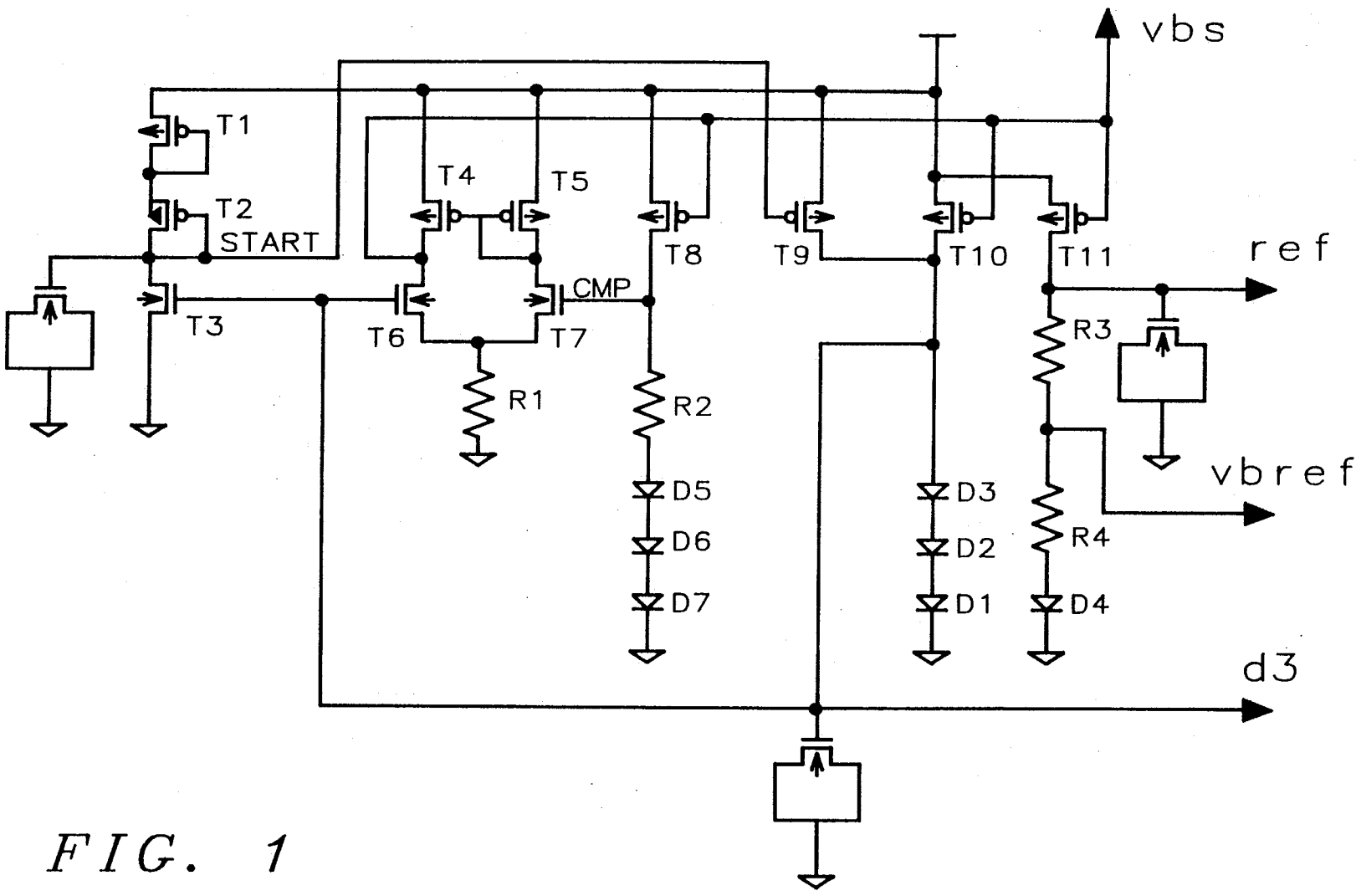

This invention relates to a circuit for forming an accurate reference voltage, particularly for a voltage regulator that is used for an FET memory.

INTRODUCTION

This invention provides an accurate reference voltage that is particularly useful in the voltage regulator of a power supply. Although voltage regulators are well known, it will be helpful to summarize the features of a voltage regulator that particularly apply to this invention.

A series voltage regulator commonly has a power transistor that is controlled from a differential amplifier. The regulator operates from a regulated power supply having a somewhat higher voltage. For example, a regulator producing a 3.3 volt output could operate from a 5 volt power supply. One input of the differential amplifier receives a fraction of the voltage at the regulator output and the other input receives a reference voltage that is the corresponding fraction of the regulated voltage. In regulators that this invention will be used with, the reference voltage is half the regulated voltage, for example a 1.65 volt reference for a voltage regulator that produces a 3.3 volt output.

SUMMARY OF THE INVENTION

One object of this invention is to provide an improved reference voltage circuit for a voltage regulator. This reference voltage circuit has a diode-resistor string and an FET connected to operate as a current source for the string. The gate terminal of the FET is given a suitable voltage to cause the FET drain current to create the reference voltage drop across this string.

This reference voltage is varied with chip temperature, and this feature is particularly advantageous for a voltage regulator for an FET memory. (The capacitor charge that represents a data bit leaks from a storage cell faster at a higher chip temperature.)

The gate voltage for the current source is controlled by a differential amplifier. Both inputs of the differential amplifier receive a reference voltage from separate diode strings that are each connected to separate current source FETs. One diode string has large diodes and the other string has small diodes. The diodes give the two strings different temperature characteristics, and the differential amplifier controls the current source FET to increase the reference voltage at an appropriate rate as the chip temperature increases.

THE DRAWING

The single FIGURE is a schematic of the preferred reference voltage circuit of this invention.

THE PREFERRED EMBODIMENT

The Circuit of FET T11

P-channel FET T11 has its source terminal connected to VDD, and its gate terminal is given an appropriate voltage (as described later) to form a current source. (The arrow out of the schematic denotes a p-channel FET.) Two resistors R3 and R4 and a diode D4 connect the drain of T11 to ground. The reference voltage, ref, is formed at the drain terminal of FET T11 by the voltage drops across R3, R4 and D4. An FET is connected to form a capacitor at this terminal.

Another output voltage, vbref (band gap voltage), of 1.2 volts is formed at the common connection point of resistors R3 and R4.

Other components in the drawing establish the appropriate voltage at the gate terminal of FET T11 to provide the selected value of voltage ref and these components vary the gate voltage in response to the chip temperature so that the current of T11 increases and voltages ref and vbref are increased by an appropriate amount when the chip temperature increases.

The First Diode Reference Voltage String (Voltage Signal CMD)

Two diode strings and current sources provide reference voltages, d3 and CMP, for the differential amplifier.

The diode strings provide temperature compensation. In the first reference voltage string, diodes D5, D6, D7 are connected in series with a resistor R2 and FET T8. The voltage across the resistor adds to the reference (it is below the node CMP).

P-channel FET T8 is connected to form a current source. Its source terminal is connected to VDD and its drain terminal is connected to the resistor-diode string. Note that the gate of T8 is connected to the output of the differential amplifier (for an operation that will be described later). The operation of T10 will be described later.

The Second Diode Reference Voltage String (d3)

D1, D2, D3 and T10 are similar to the string just described, except as will be explained here. These diodes are small in comparison with D5–D7 and their voltage changes less with temperature than the diodes of the first string. Note the capacitor connected to node d3 whereas there is no corresponding capacitor at node CMP. FET T9 is part of the Start circuit that will be described later.

Temperature Compensation

The voltage drop across a diode varies as a function of temperature and, as is known, the large diodes (D5, D6 and D7) have a higher temperature dependence than the small diodes (D1, D2 and D3). Recall that the voltages d3 and CMP are approximately equal; when the chip temperature changes, the difference between voltages d3 and CMP also changes. (An example will be given later.)

The Differential Amplifier

FETs T4, T5, T6 and T7 and a resistor R1 form a differential amplifier. N-channel FETs T6 and T7 are connected to receive inputs d3 and CMP respectively from the first and second diode strings. P-channel FETs T4 and T5 have their source terminals connected to VDD and their gate terminals connected together so that they act as similar current sources according to the voltage at the gate connection.

The gate terminals of FETs T4 and T5 are connected to the drain terminal of FET T7. The output of the differential amplifier, at the drain terminal of FET T6, is connected to an output pad vbs and it will be called by this pad name.

Operation in Response to the Inputs d3 and CMP

Voltages d3 and CMP are approximately equal and the two FETs T6 and T7 of the differential amplifier conduct approximately equally. (Voltages d3 and CMP change with temperature as will be explained.) At a selected temperature (ordinarily room temperature), the voltage vbs at the drain terminal of FET T6 and the gate terminal of FET T11 establishes a current level in FET T11 that produces a desired voltage drop (1.65 volts in the specific circuit being described) across the string of components at the drain terminal of T11.

Operation in Response to a Temperature Change

As an example, suppose that the chip temperature rises from 0° C. to 90° C. More current will flow in the first string (D3, D2, D1) and thereby produce a larger drop across R2 and a higher voltage CMP at the gate of FET T7. The current in the second string does not increase to a corresponding degree, and the voltage d3 at the gate of FET T6 remains relatively unchanged.

In response to this change in the input voltage CMP, the differential amplifier lowers the voltage vbs at the drain terminal of FET 6 and the gate terminal of T11 and thereby causes T11 to conduct more current. The degree of change in the reference voltage with temperature is a function of characteristics of the diodes, the gain of the differential amplifier, and the values of the resistors connected to the drain terminal of FET T11. Thus, the circuit can easily be adapted to provide a particular voltage, ref, and a particular relationship between this voltage and chip temperature.

The Start Circuit

FETs T1, T2, T3 and T9 cooperate to start the circuit when it first receives power. FET T9 is connected in parallel with FET T10, and when T9 turns on (in response to a signal on a line Start as described later), it pulls up node d3 and thereby turns on FET T7 in the differential amplifier. The amplifier then lowers its output voltage vbs which turns on the current source FETs T8, T10 and T11. The line Start connects the gate terminal of FET T9 to the drain terminal of FET T3.

P-channel FETs T1 and T2 are each connected to produce a threshold voltage designated Vt across its source and drain terminals. (FET T3 is much smaller than T1 and T2). When the circuit first receives power, T3 turns on in response to an, up level at its gate (node d3) and produces a voltage $VDD-2\sigma_T$ at the gate terminal of FET T9.

Other Embodiments

From the description of the preferred embodiment of this reference voltage circuit and the explanation of its operation, those skilled in the art will recognize appropriate modifications within the spirit of the invention and the intended scope of the claims.

What is claimed is:

1. A circuit for producing a reference voltage (ref), comprising an FET (T11) connected as a current surface and a resistor (R3) and a diode (D4) connected between the drain terminal of the current source FET and circuit ground to produce the reference voltage (ref) in response to a current at the drain terminal of the FET, a differential amplifier having a first (T6) and a second (T7) FET connected with a resistor (R1) to conduct differentially in response to the voltage at the gate terminals of the first and second FETs, the gate terminals of the first and second FETs being designated a first input and a second input respectively, and a third (T4) and a fourth (T5) FET each connected as a load device, the gate terminals of the third and fourth FETs being connected to the drain terminal of the second FET and the drain terminal of the first FET forming an output for the differential amplifier, and means connecting the output of the differential amplifier to control the conduction of the current source FET and thereby control the reference voltage, a first diode strip (D1, D2 and D3) and first FET means (T10) connected to the first diode string for providing a voltage (d3) at the first input of the differential amplifier and a second diode string (D5, D6 and D7) and second FET means (T8) connected to the second diode string for providing a voltage (CMP) at the second input of the differential amplifier.

the second diode string including a resistor (R2) for further increasing the voltage drop across the strip (CMP) when current in the second diode string is increased, the gate terminals of the first and second FETs being connected to the output of the amplifier for increasing the current through the first and second strings when the amplifier output increases, the diodes having a voltage that varies with temperature and varies with the diode current, and the second diode string (D5, D6 and D7) having larger diodes than the first diode string to provide a more positive temperature coefficient whereby the voltage at the second input and the reference voltage are increased with temperature.

2. The reference voltage circuit of claim 1 including means for turning on the first FET means (T10) when power is first applied to the circuit, comprising an FET (T9) connected in parallel with the first FET means, and means connected to the gate of the FET for turning it on when power is first applied to the circuit.

3. A voltage reference circuit for producing a reference voltage, comprising an FET (T11) connected as a current source and a diode (D4) and a resistor (R3) connected between the drain terminal of the current source FET and circuit ground to produce a reference voltage (ref) in response to a current at the drain terminal of the FET, a differential amplifier comprising, a first (T6) and a second (T7) FET connected with a resistor (R1) to conduct differentially in response to the voltage at the gate terminals of the first and second FETs, the gate terminals of the first and second FETs being designated a first input and a second input respectively, a third (T4) and a fourth (T5) FET each connected as a load device, the gate terminals of the third and fourth FETs being connected to the drain terminal of the second FET and the drain terminal of the first FET forming an output for the differential amplifier, and means connecting the output of the differential amplifier to control the conduction of the current source FET, first means for providing a voltage at the first input, comprising a first string of diodes (D1, D2, D3) and first FET means (T10) connected to the first diode string for supplying current to the diodes, a point (d3) on the first diode string being connected to the first input of the differential amplifier, and second means for providing a voltage at the second input, comprising a second string of diodes (D5, D6, D7) and second FET means (T8) connected to the second string for supplying current to the diodes, a point (CMP) on the second diode string being connected to the second input of the differential amplifier, the second diode string further including a resistor (R2) in series circuit with the diodes for further increasing the voltage drop across the strip (CMP) when the current in the second diode string is increased, the gate terminals of the first and second FETs being connected to the output of the amplifier for increasing the current through the first and second diode strings when the output of the differential amplifier increases, the diodes in the first and second strings having a voltage that varies with temperature and varies with the diode current, the diodes of the second string being larger than the diodes of the first string and thereby providing a greater ratio of voltage change to temperature change than the diodes of the first string, whereby the voltages at the first and second inputs stabilize the output voltage with respect to temperature changes.

4. The reference voltage circuit of claim 3 including means for turning on the first FET means (T10) when power is first applied to the circuit, comprising an FET (T9) connected in parallel with the first FET means, and means connected to the gate of the FET for turning it on when power is first applied to the circuit.

5. The voltage reference circuit of claim 3 wherein the components connected between the drain terminal and ground comprise a diode (D4) and a resistor (R3).

* * * * *